US007096523B2

(12) United States Patent
Hennings et al.

(10) Patent No.: US 7,096,523 B2
(45) Date of Patent: Aug. 29, 2006

(54) UNIVERSALLY ADJUSTABLE BED LOFT

(76) Inventors: Eric D. Hennings, 2670 180th St., Moville, IA (US); Donald R. Hennings, 1970 Garner Ave., Moville, IA (US)

( * ) Notice: Subject to any disclaimer, the term of this patent is extended or adjusted under 35 U.S.C. 154(b) by 28 days.

(21) Appl. No.: 10/976,224

(22) Filed: Oct. 28, 2004

(65) Prior Publication Data

US 2006/0090262 A1 May 4, 2006

(51) Int. Cl.
*A47C 19/00* (2006.01)

(52) U.S. Cl. ..... 5/9.1; 5/11; 5/310

(58) Field of Classification Search ..... 5/181, 5/183–185, 8, 9.1, 310, 11; 248/149; 182/178.1
See application file for complete search history.

(56) References Cited

U.S. PATENT DOCUMENTS 4,679,261 A * 7/1987 Stanley et al. ..... 5/183
5,150,484 A * 9/1992 Whitten, Jr. ..... 5/9.1
5,575,023 A * 11/1996 McCumber ..... 5/9.1
6,292,959 B1 * 9/2001 Rosenquist ..... 5/9.1
6,581,221 B1 * 6/2003 Rosenquist ..... 5/9.1
6,675,409 B1 1/2004 O'Dell, Jr.
6,836,912 B1 * 1/2005 Morris ..... 5/181

* cited by examiner

*Primary Examiner*—Michael Trettel
(74) *Attorney, Agent, or Firm*—Kinney & Lange, P.A.

(57) ABSTRACT

The present invention is a bed loft comprising a pair of end assemblies and at least one support beam for receiving a support beam prong. Each end assembly comprises a first post and a second post. The first post comprises at least one support beam prong for insertion into the support beam, at least one end assembly prong for insertion into an end assembly support beam, and a receiver for holding a foot of a bedpost. The second post comprises at least one end assembly support beam for receiving an end assembly prong and a receiver for holding a foot of a bedpost.

54 Claims, 6 Drawing Sheets

UNIVERSALLY ADJUSTABLE BED LOFT

BACKGROUND OF THE INVENTION

There are many advantages to lofting a bed in circumstances where floor space is scarce, such as in a dormitory situation. It is advantageous to use the same floor space for the bed and for other furniture such as a desk, couch or dresser. It is not possible, however, to loft every bed without making permanent modifications that can blemish the bedframe. Also, not every bed frame is of the exact same dimensions. Therefore, there is a need for a system for lofting a bed that can accept a broad range of existing bed styles and designs without making modifications to the bedframe.

BRIEF SUMMARY OF THE INVENTION

The present invention is a bed loft comprising a pair of end assemblies and at least one support beam. Each end assembly comprises a first post and a second post. The first post comprises at least one support beam prong for insertion into the support beam, at least one end assembly prong for insertion into an end assembly support beam, and a receiver for holding a foot of a bedpost. The second post comprises at least one end assembly support beam for receiving an end assembly support prong and a receiver for holding a foot of a bedpost. The length and width of the bed loft is adjusted by sliding the support beam and end assembly support beam along the support prongs and end assembly prongs, respectively. Locking means fix the position of the support beam and end assembly support beam. In another embodiment of the present invention the first and second posts are further broken down into smaller sections. The height of the loft can be adjusted by adding or subtracting sections. The present invention also discloses a method for assembling an adjustable bed loft.

DETAILED DESCRIPTION

FIG; 1 shows one embodiment of an assembled universally adjustable bed loft 10 holding a bed frame 2 (shown in phantom). The universally adjustable bed loft 10 comprises a first end assembly 12F, a second end assembly 12B, an upper support beam 18U and a lower support beam 18L.

End assembly 12F is comprised of a first post 14FL and a second post 14FR. End assembly 12B is comprised of a third post 14BL and a fourth post 14BR.

The first post 14FL is comprised of a first support beam prong 22A, a second support beam prong 22B, a first end assembly prong 17A, a second end assembly prong 17B, a third end assembly prong 17C, and a first receiver unit 20A.

The second post 14FR is comprised of a first end assembly support beam 16A, a second end assembly support beam 16B, a third end assembly support beam 16C and a second receiver unit 20B.

The third post 14BL is comprised of a third support beam prong 22C, a fourth support beam prong 22D, a fourth end assembly prong 17D, a fifth end assembly prong 17E, a sixth end assembly prong 17F, and a third receiver unit 20C.

The fourth post 14BR is comprised of a fourth end assembly support beam 16D, a fifth end assembly support beam 16E, a sixth end assembly support beam 16F and a fourth receiver unit 20D.

The support beams 18U, 18L and end assembly support beams 16A, 16B, 16C, 16D, 16E, 16F also have locking means 26 for securing attachment to the support beam prongs 22A, 22B, 22C, 22D and end assembly prongs 17A, 17B, 17C, 17D, 17E, 17F, 17G, respectively. The head board or foot board 6 of the bed frame 2 rests on the end assemblies 12F, 12B such that the legs 4A, 4B, 4C, 4D of the bed frame 2 are positioned in the receiver units 20A, 20B, 20C, 20D. The receiver units 20A, 20B, 20C, 20D are located at the top ends of the posts 14FL, 14FR, 14BL, 14BR such that when the bed frame 2 is resting in the receiver units 20A, 20B, 20C, 20D the weight of the bed frame 2 is supported by the posts 14FL, 14FR, 14BL, 14BR.

Figure 1:
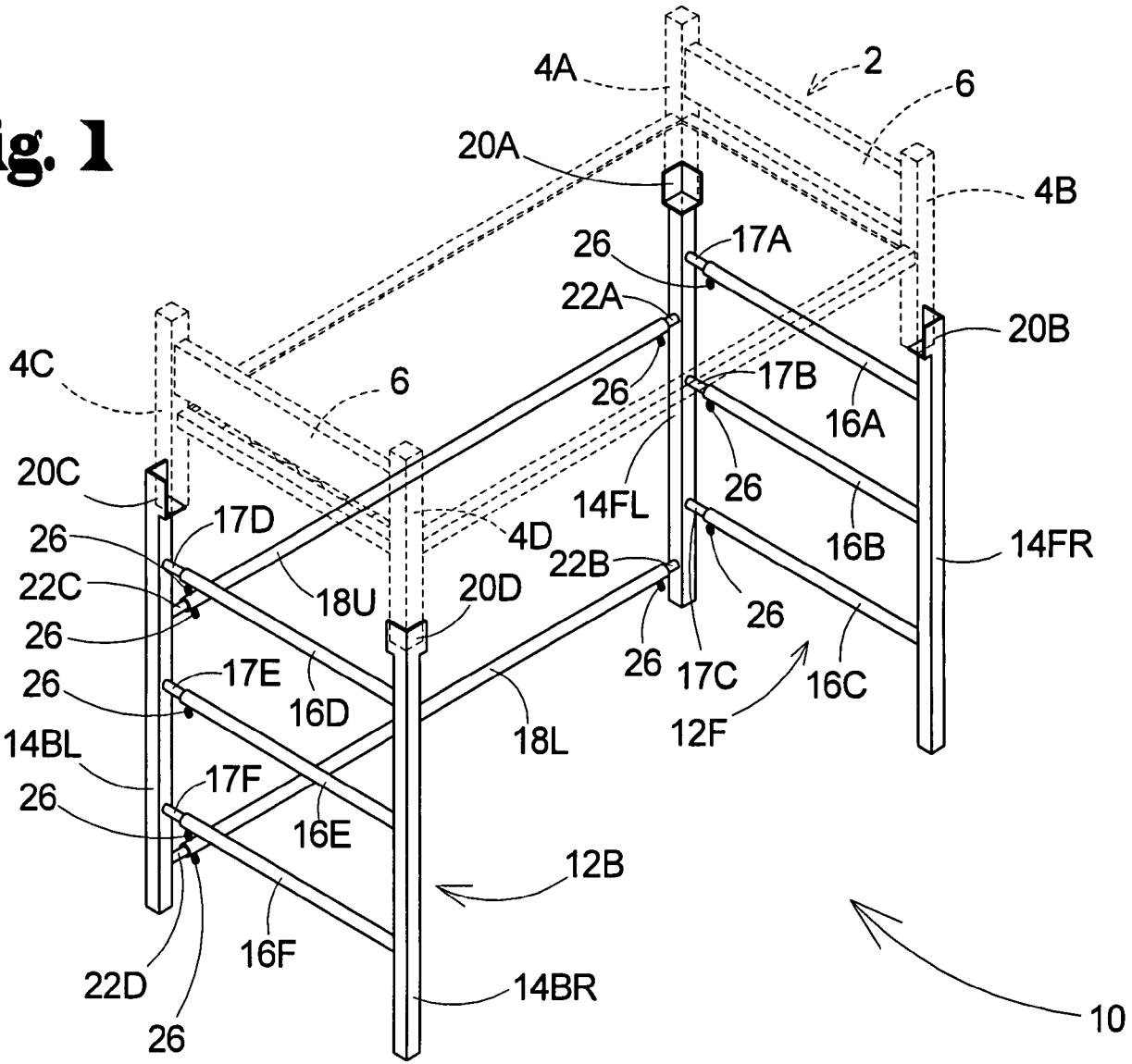
FIG. 1 shows one embodiment of an assembled universally adjustable bed loft holding a bed frame.
Figure 2:
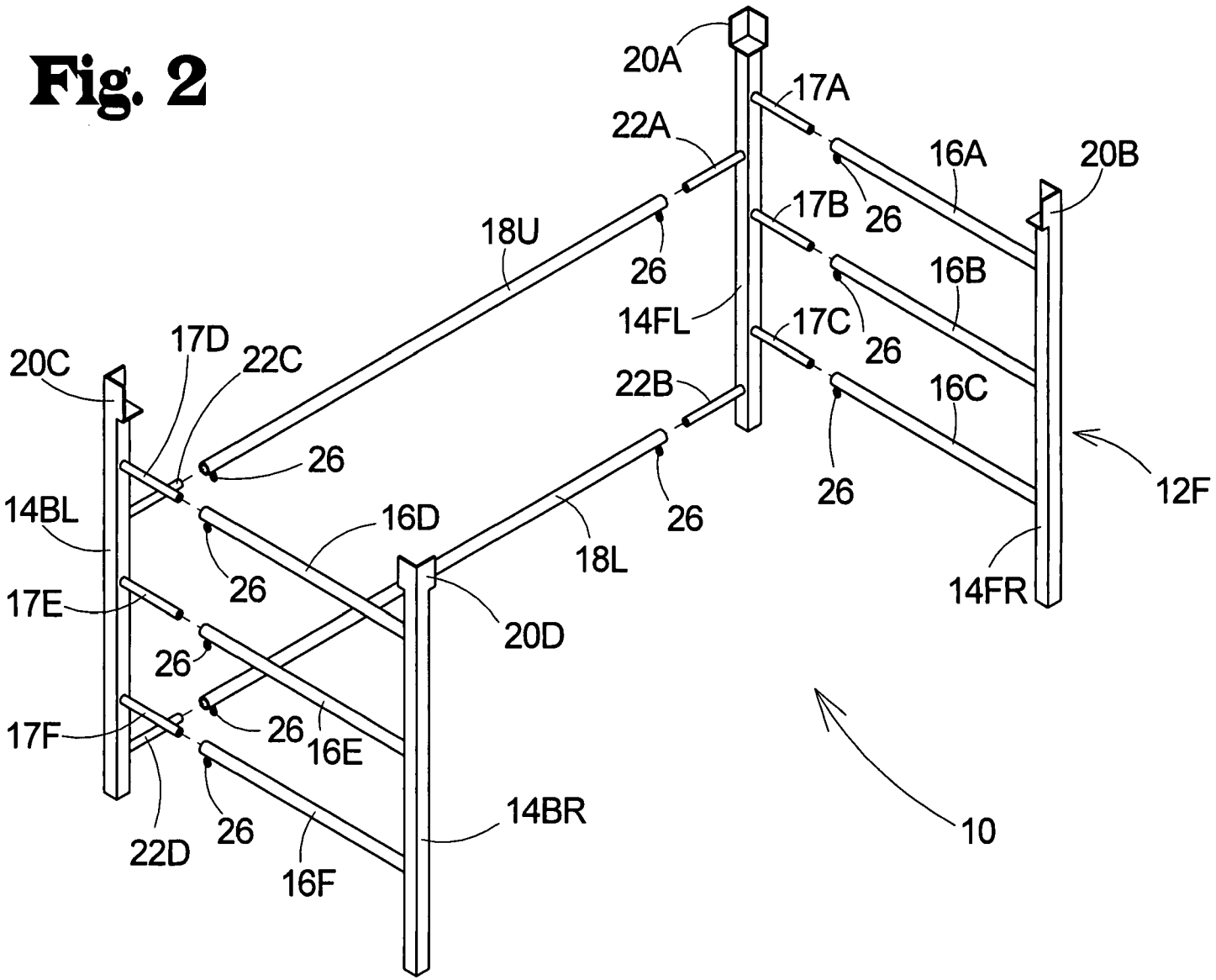
FIG. 2 shows an exploded view of the universally adjustable bed loft of FIG. 1.

FIG. 2 shows an exploded view of the universally adjustable bed loft 10 of FIG. 1. The universally adjustable bed loft 10 comprises a first end assembly 12F, a second end assembly 12B, an upper support beam 18U and a lower support beam 18L. End assembly 12F is comprised of a first post 14FL and a second post 14FR. End assembly 12B is comprised of a third post 14BL and a fourth post 14BR. In the embodiment shown, the end assemblies 12F, 12B are designed to be at opposite ends of the bed frame 2. The first post 14FL and third post 14BL of the end assemblies 12F, 12B are designed to be along a wall or to form a side of the universally adjustable bed loft 10 that will be less accessible to the user.

The first post 14FL is comprised of a first support beam prong 22A, a second support beam prong 22B, a first end assembly prong 17A, a second end assembly prong 17B, a third end assembly prong 17C, and a first receiver unit 20A. The support beam prongs 22A, 22B have one end that is rigidly attached to the first post 14FL and one end that is adapted for insertion into one of the support beams 18U, 18L. The support beam prongs 22A, 22B are attached to the back side of the first post 14FL so that they face the front side of the third post 14BL. The end assembly prongs 17A, 17B, 17C have one end that is rigidly attached to the first post 14FL and one end that is adapted for insertion into one of the end assembly support beams 16A, 16B, 16C. The end assembly prongs 17A, 17B, 17C are attached to the right side of the first post 14FL so that they face the left side of the second post 14FR.

The second post 14FR is comprised of a first end assembly support beam 16A, a second end assembly support beam 16B, a third end assembly support beam 16C and a second receiver unit 20B. The end assembly support beams 16A, 16B, 16C have one end that is rigidly attached to the second post 14FR and one end that is adapted for receiving one of the end assembly prongs 17A, 17B, 17C. The end assembly support beams 16A, 16B, 16C are attached to the left side of the second post 14FR so that they face the right side of the first post 14FL.

The third post 14BL is comprised of a third support beam prong 22C, a fourth support beam prong 22D, a fourth end assembly prong 17D, a fifth end assembly prong 17E, a sixth end assembly prong 17F, and a third receiver unit 20C. The support beam prongs 22C, 22D have one end that is rigidly attached to the third post 14BL and one end that is adapted for insertion into one of the support beams 18U, 18L. The support beam prongs 22C, 22D are attached to the front side of the third post 14BL so that they face the back side of the first post 14FL. The end assembly prongs 17D, 17E, 17F have one end that is rigidly attached to the third post 14BL and one end that is adapted for insertion into one of the end assembly support beams 16D, 16E, 16F. The end assembly prongs 17D, 17E, 17F are attached to the right side of the third post 14BL so that they face the left side of the fourth post 14BR.

The fourth post 14BR is comprised of a fourth end assembly support beam 16D, a fifth end assembly support beam 16E, a sixth end assembly support beam 16F and a fourth receiver unit 20D. The end assembly support beams 16D, 16E, 16F have one end that is rigidly attached to the fourth post 14BR and one end that is adapted for receiving one of the end assembly prongs 17D, 17E, 17F. The end assembly support beams 16D, 16E, 16F are attached to the left side of the fourth post 14BR so that they face the right side of the third post 14BL.

Each end of the support beam 18U is adapted for receiving support beam prongs 22A, 22C. Each end of the support beam 18L is adapted for receiving support beam prongs 22B, 22D.

The end assembly prongs 17A, 17B, 17C of the first post 14FL are inserted into the end assembly support beams 16A, 16B, 16C of the second post 14FR. The distance that the end assembly prongs 17A, 17B, 17C are inserted into the end assembly support beams 16A, 16B, 16C is set to match the width of the head board or footboard 6 of the bed frame 2 such that the legs 4A, 4B of the bed frame 2 will rest inside the receiver units 20A, 20B. The locking means 26 is then used to fix the position of the end assembly support beams 16A, 16B, 16C. Thus, when fully assembled the first post 14FL and second post 14FR are rigidly connected to each other at a distance that fits the width of a desired bed frame 2.

The end assembly prongs 17D, 17E, 17F of the third post 14BL are inserted into the end assembly support beams 16D, 16E, 16F of the fourth post 14BR. The distance that the end assembly prongs 17D, 17E, 17F are inserted into the end assembly support beams 16D, 16E, 16F is set to match the width of the head board or footboard 6 of the bed frame 2 such that the legs 4C, 4D of the bed frame 2 will rest inside the receiver units 20C, 20D. The locking means 26 is then used to fix the position of the end assembly support beams 16D, 16E, 16F. Thus, when fully assembled the third post 14BL and fourth post 14BR are rigidly connected to each other at a distance that fits the width of a desired bed frame 2.

The support beam prongs 22A, 22B of the first post 14FL are inserted into a first end of the support beams 18U, 18L. The support beam prongs 22C, 22D of the third post 14BL are inserted into a second end of the support beams 18U, 18L. The distance that the support beam prongs 22A, 22B, 22C, 22D are inserted into the support beams 18U, 18L is set to match the length of the bed frame 2 such that the legs 4A, 4B, 4C, 4D of the bed frame 2 will rest inside the receiver units 20A, 20B, 20C, 20D. The locking means 26 is then used to fix the position of the support beams 18U, 18L. Thus, when fully assembled the end assemblies 12F, 12B are rigidly connected to each other by the support beams 18U, 18L at a distance that fits the length of a desired bed frame 2.

In another embodiment of the invention, the support beams 18U, 18L and end assembly support beams 16A, 16B, 16C, 16D, 16E, 16F can themselves be of a telescoping construction wherein the support beam 18U, 18L or end assembly support beam 16A, 16B, 16C, 16D, 16E, 16F collapses inside itself. This helps with storage and assembly of the universally adjustable bed loft 10. The support beam prongs 22A, 22B, 22C, 22D and end assembly prongs 17A, 17B, 17C, 17D, 17E, 17F may also be of a telescoping construction.

The receiver units 20A, 20B, 20C, 20D are affixed to the top end of each post 14FL, 14FR, 14BL, 14BR, respectively, of each end assembly 12F, 12B. The receiver units 20A, 20B, 20C, 20D provide a platform for the posts of the bed frame 2 to rest upon. The receiver units 20A, 20B, 20C, 20D also have barriers for inhibiting the movement of the legs 4 of the bed frame 2. The operation of the receiver units 20A, 20B, 20C, 20D is shown in further detail in FIG. 5.

The posts 14FL, 14FR, 14BL, 14BR may be of square tubing as depicted in FIGS. 1 and 2. However, any suitable material can be used. The posts 14FL, 14FR, 14BL, 14BR may be made of metal, wood, plastic or composite material and may have a variety of cross sections, such as round, oval, or polygonal. Materials such as angle irons, I beams, girders or steel tubing may be used in the construction of the posts 14FL, 14FR, 14BL, 14BR.

The outside diameter of the support beam prongs 22A, 22B, 22C, 22D is smaller than the inside diameter of the support beams 18U, 18L such that they will fit one inside the other. The shape of the support beam prongs 22A, 22B, 22C, 22D does not have to match the shape of the support beams 18U, 18L. It is only necessary that the support beam prong 22A, 22B, 22C, 22D fit securely inside the support beams 18U, 18L. The support beam prongs 22A, 22B, 22C, 22D and the support beams 18U, 18L can be of any suitable cross section that facilitates the desired telescoping effect, such as circular, square or rectangular. In another embodiment of the present invention, the inside diameter of the support beam prongs 22A, 22B, 22C, 22D can larger than the outside diameter of the support beams 18U, 18L such that the support beams 18U, 18L fit inside the support beam prongs 22A, 22B, 22C, 22D.

The end assembly prongs 17A, 17B, 17C, 17D, 17E, 17F and the end assembly support beams 16A, 16B, 16C, 16D, 16E, 16F operate in a manner similar to the support beam prongs 22A, 22B, 22C, 22D and support beams 18U, 18L. The end assembly prongs 17A, 17B, 17C, 17D, 17E, 17F and end assembly support beams 16A, 16B, 16C, 16D, 16E, 16F need not be of the same diameter or cross section as the support beam prongs 22A, 22B, 22C, 22D and support beams 18U, 18L.

The end assembly support beams 16A, 16B, 16C, 16D, 16E, 16F also serve as steps for climbing the universally adjustable bed loft 10 to gain access to the bed frame 2. The end assembly support beams 16A, 16B, 16C, 16D, 16E, 16F can, therefore, include features to assist climbing, such as having a flat surface for squarely placing a foot or having the surface texture enhanced to facilitate gripping.

The attachment of the support beam prongs 22A, 22B, 22C, 22D and end assembly prongs 17A, 17B, 17C, 17D, 17E, 17F to the fist post 14FL and third post 14BL, and the attachment of the end assembly support beams 16A, 16B, 16C, 16D, 16E, 16F to the second post 14FR and fourth post 14BR can be achieved by using any suitable method. They may be permanently attached with welding methods or removably attached with a threaded fastener system or other mechanical system.

In the embodiment of FIG. 2 the universally adjustable bed loft 10 is described as having support beams 18U, 18L on only the left side of each end assembly 12F, 12B. This is the side of the universally adjustable bed loft 10 intended to be placed alongside a wall. It is also possible for this invention to include support beams on both the left and right sides of the end assemblies 12F, 12B. In this configuration additional support beam prongs would be attached to the back side of the second post 14FR for insertion into a first end of additional support beams. Additional support beam prongs would also be attached to the front side of the fourth post 14BR for insertion into a second end of the additional support beams. The support beam prongs could be positioned near the top and bottom ends of the second post 14FR and fourth post 14BR to facilitate easy access to the floor space below the bed frame 2. Also, only one additional support beam could be used.

Figure 3:
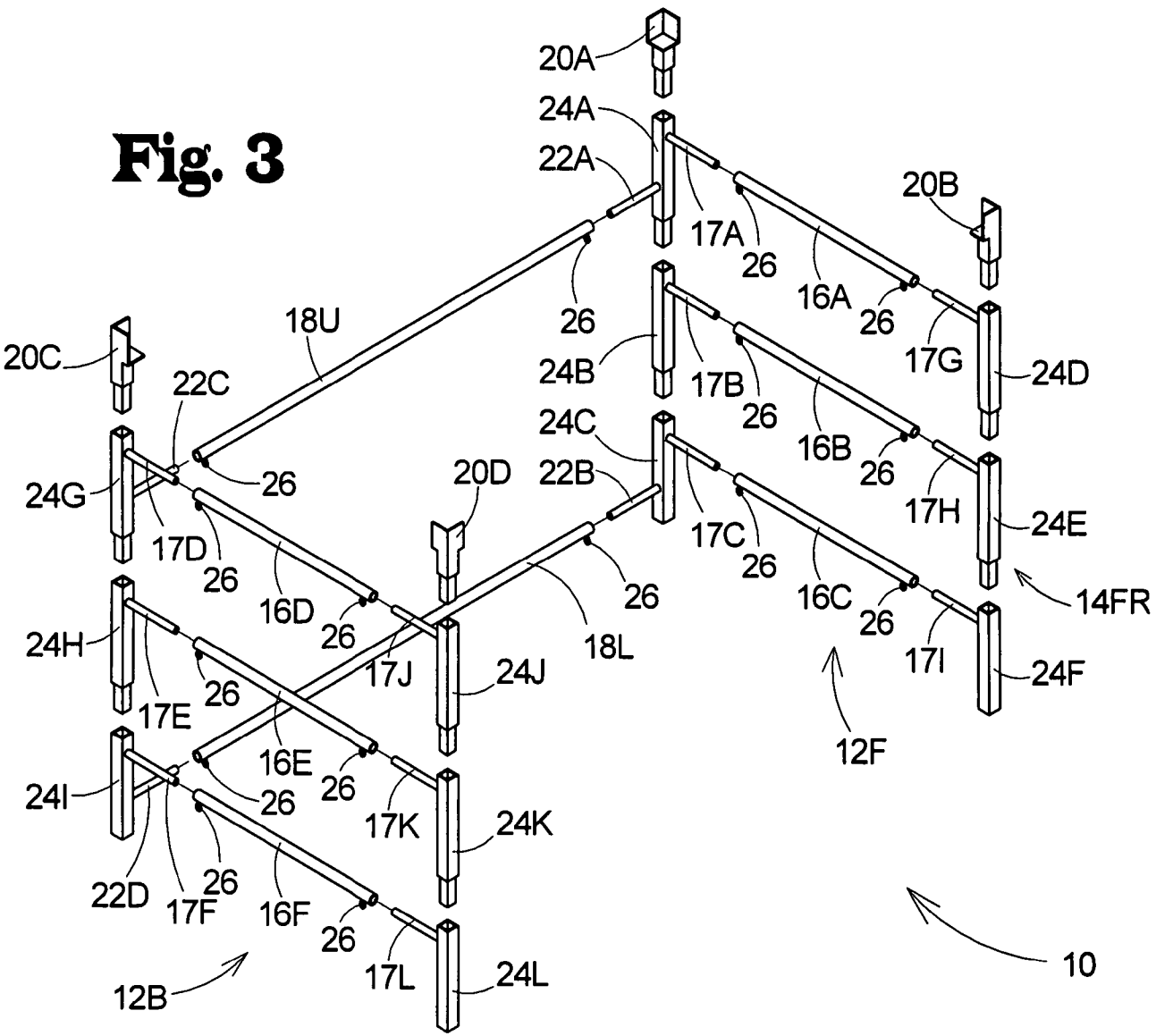
FIG. 3 shows an exploded view of a second embodiment of the universally adjustable bed loft.

FIG. 3 shows an exploded view of a second embodiment of the universally adjustable bed loft 10. In this embodiment the end assembly support beams 16A, 16B, 16C, 16D, 16E, 16F are detachable from the second post 14FR and fourth post 14BR, respectively. The second post 14FR would then have a seventh end assembly prong 17G, a eighth end assembly prong 17H, and an ninth end assembly prong 171 for insertion into an open end of one of the end assembly support beams 16A, 16B, 16C. The fourth post 14BR would then have a tenth end assembly prong 17J, an eleventh end assembly prong 17K, and a twelfth end assembly prong 17L for insertion into an open end of one of the end assembly support beams 16D, 16E, 16F. The end assembly support beams 16A, 16B, 16C, 16D, 16E, 16F would also have locking means 26 at both ends. The receiver units 20A, 20B, 20C, 20D can also constitute a separate piece of the posts 14FL, 14FR, 14BL, 14BR.

Also, in this embodiment, the first post 14FL is broken down into three sections 24A, 24B, 24C. The second post 14FR is broken down into three sections 24D, 24E, 24F. The third post 14BL is broken down into three sections 24G, 24H, 241. The fourth post 14BR is broken down into three sections 24J, 24K, 24L. The sections 24A, 24B, 24C, 24D, 24E, 24F, 24G, 24H, 241, 24J, 24K, 24L are constructed to have a stackable interlocking means. The end units 20A, 20B, 20C, 20D can also have a necked down end to facilitate telescopic stacking on sections 24A, 24D, 24G, 24J.

Section 24A carries the first end assembly prong 17A and the first support beam prong 22A. The top of section 24A is open for receiving the first receiver unit 20A. The bottom of section 24A is necked down for insertion into the top of section 24B.

Section 24B carries the second end assembly prong 17B. The top of section 24B is open for receiving the bottom of section 24A. The bottom of section 24B is necked down for insertion into the top of section 24C.

Section 24C carries the third end assembly prong 17C and the second support beam prong 22B. The top of section 24C is open for receiving the bottom of section 24B.

Section 24D carries the seventh end assembly prong 17G. The top of section 24D is open for receiving the second receiver unit 20B. The bottom of section 24D is necked down for insertion into the top of section 24E.

Section 24E carries the eighth end assembly prong 17H. The top of section 24E is open for receiving the bottom of section 24D. The bottom of section 24E is necked down for insertion into the top of section 24F.

Section 24F carries the ninth end assembly prong 171. The top of section 24F is open for receiving the bottom of section 24E.

Section 24G carries the fourth end assembly prong 17D and the third support beam prong 22C. The top of section 24G is open for receiving the third receiver unit 20C. The bottom of section 24G is necked down for insertion into the top of section 24H.

Section 24H carries the fifth end assembly prong 17E. The top of section 24H is open for receiving the bottom of section 24G. The bottom of section 24H is necked down for insertion into the top of section 24I.

Section 241 carries the sixth end assembly prong 17F and the fourth support beam prong 22D. The top of section 241 is open for receiving the bottom of section 24H.

Section 24J carries the tenth end assembly prong 17J. The top of section 24J is open for receiving the fourth receiver unit 20D. The bottom of section 24J is necked down for insertion into the top of section 24K.

Section 24K carries the eleventh end assembly prong 17K. The top of section 24K is open for receiving the bottom of section 24J. The bottom of section 24K is necked down for insertion into the top of section 24L.

Section 24L carries the twelfth end assembly prong 17L. The top of section 24L is open for receiving the bottom of section 24K.

With this embodiment, the height of the universally adjustable bed loft 10 is adjustable. For the tallest height setting, all of the sections 24A, 24B, 24C, 24D, 24E, 24F, 24G, 24H, 24I, 24J, 24K, 24L can be used. For shorter settings, fewer sections 24A, 24B, 24C, 24D, 24E, 24F, 24G, 24H, 24I, 24J, 24K, 24L can be used.

Figure 4:
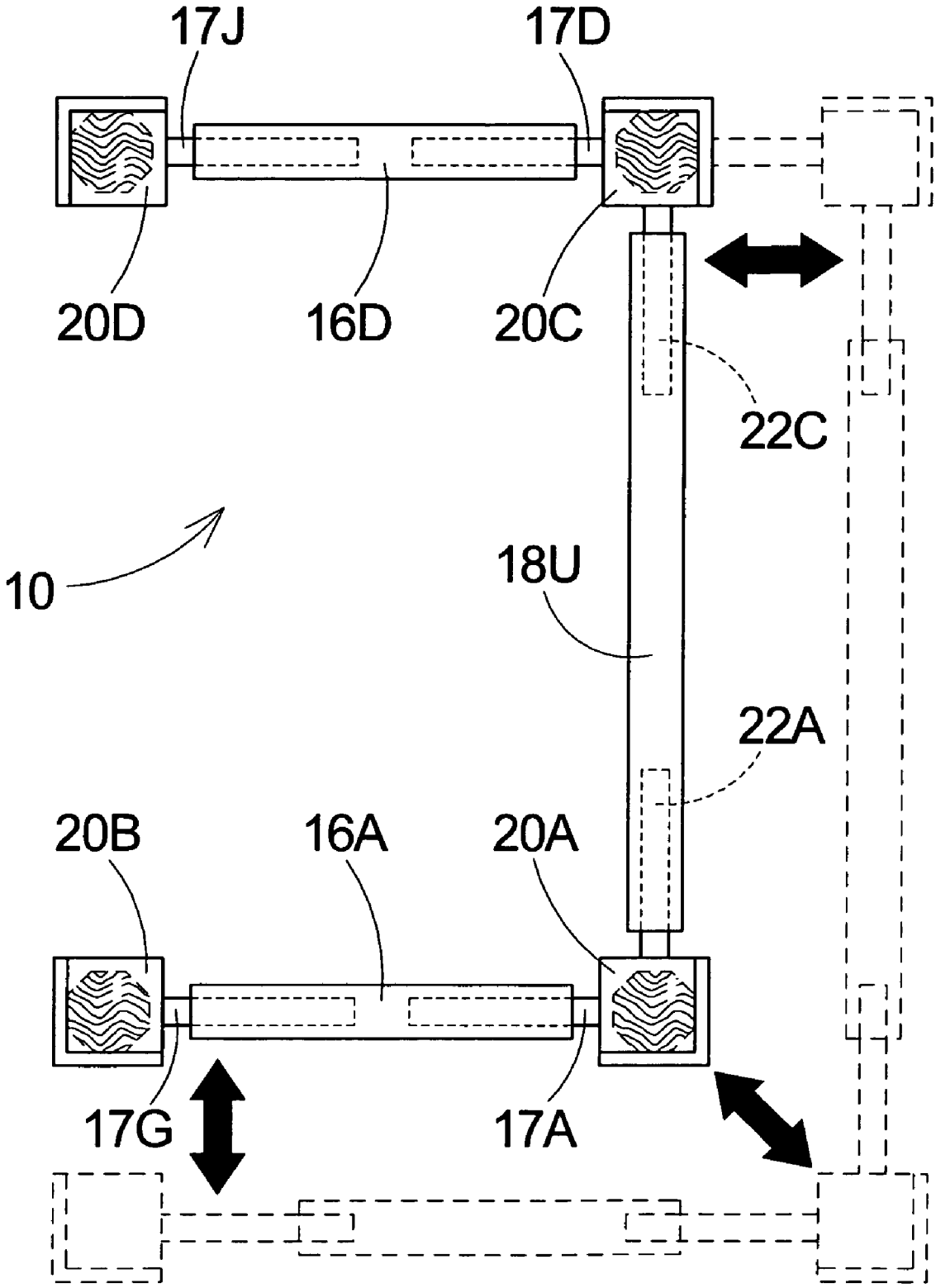
FIG. 4 shows a top view of the universally adjustable bed loft of FIG. 3 demonstrating the adjustability the bed loft.

FIG. 4 shows a top view of the universally adjustable bed loft 10 demonstrating the adjustability the bed loft. The receiver units 20A, 20B, 20C, 20D are shown atop each post. The end assembly prongs 17J, 17D, 17G, 17A and support beam prongs 22C, 22A are shown inserted into an end assembly support beams 16D, 16A and a support beam 18U. The support beam 18U slides along the support beam prongs 22C, 22A. Therefore, the amount of adjustability of the universally adjustable bed loft 10 along the length of the bed frame 2 is directly related to the length of the support beam prongs 22C, 22A and the length of the support beam. 18U. The end assembly support beams 16D, 16A slide along the end assembly prongs 17J, 17D, 17G, 17A. Therefore, the amount of adjustability of the universally adjustable bed loft 10 along the width of the bed frame 2 is directly related to the length of the end assembly prongs 17J, 17D, 17G, 17A and the length of the end assembly support beams 16D, 16A.

Figure 5:
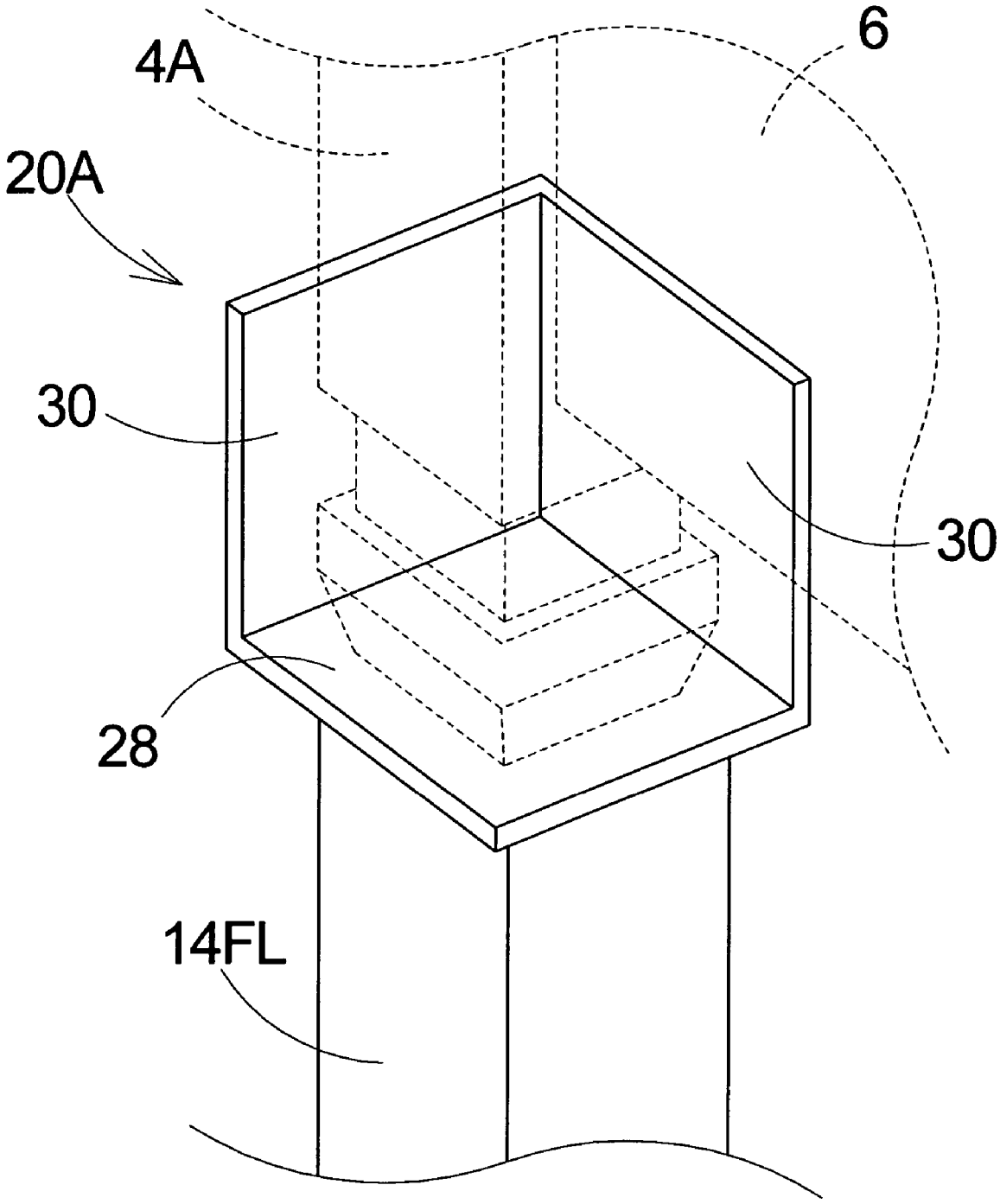
FIG. 5 is a perspective view of the receiver unit of the universally adjustable bed loft holding a bedframe post.

FIG. 5 is a perspective view of the receiver unit 20A of the universally adjustable bed loft 10 holding a bed leg 4A. A headboard or footboard 6 is resting on the end assembly 12 such that a bed leg 4A rests vertically on the receiver unit 20. The receiver unit 20A is attached to the top end of the first post 14FL. The receiver unit 20A may be permanently attached or removably attached.

The receiver unit 20A is comprised of a platform 28 and barriers 30. The area of the platform 28 is large enough to accommodate most any sized foot of a bed leg 4. In this embodiment, it is anticipated that the area of the platform 28 be larger than the area of the cross sectional area of the first post 14FL. The platform 28 is also generally flat to accept most bed legs 4A. The platform 28 may also be cupped or lipped for cradling the bed leg 4A. The platform 28 may also be slanted or indented to bias the bed leg 4A against the barrier 30. The platform 28 may also have cushioning material or enhanced surface features to provide a better grip between the platform 28 and bed leg 4A.

Movement of the bed leg 4A is restricted by barriers 30. The platform 28 may have barriers 30 that completely surround the bed leg 4A, or there may only be enough barriers 30 such that the bed frame 2 is immobilized by use of all four receiver units 20A, 20B, 20C, 20D. In one embodiment, as shown in FIG. 5, there are only two barriers 30 on the receiver unit 20A. When used in conjunction with three other receiver units 20B, 20C, 20D with two barriers 30, the bed frame 2 is completely immobilized in any horizontal direction. In this embodiment, the receiver unit 20A can accept bed frames 2 in which the head board or foot board 6 is placed very near the bottom of the bed leg 4A. The barriers 30 are placed only on the exterior portion of the platform 28 such that the barriers 30 will not interfere with the headboard or footboard 6.

The barriers 30 should be of sufficient height to ensure immobility of the bed leg 4A during the normal course of usage of the universally adjustable bed loft 10, such as climbing and entering of the bed by a user. The barriers 30 may also have grip enhancing features as the platform 28 does. The receiver unit 20A may include additional features to further secure the bed leg 4A to the receiver unit 20A. For example, the barriers 30 may have holes to accommodate a bolt or screw to fasten the bed leg 4A to the barrier 30. Other clamping or banding means may also be used.

In another embodiment of the invention, the platform 28 is enclosed within the walls of the first post 14FL. The walls of the first post 14FL are then the barriers 30. Portions of the walls of the first post 14FL can be removed to allow for insertion of the bed leg 4A. The area of the platform 28 is then roughly the area of the cross section of the first post 14FL.

Figure 6A:
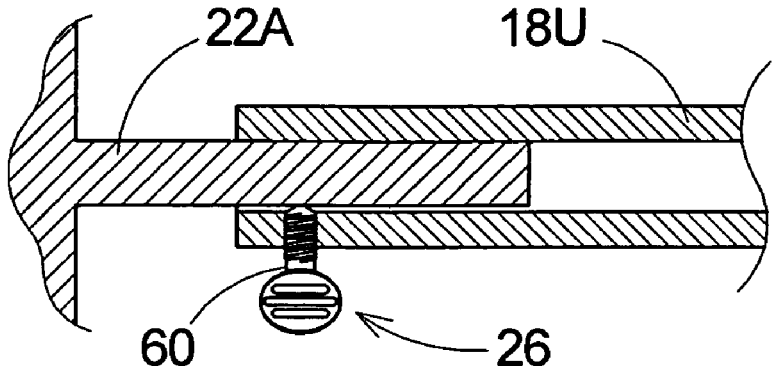
FIG. 6A is a cross-section view of a first embodiment of the locking means of the universally adjustable bed loft.

FIGS. 6A–6D are cross-section views of various embodiments of the locking means 26. FIG. 6A depicts a threaded tension screw 60 that when threaded through the support beam 18U and biased against the support beam prong 22 would secure the support beam 18U to the support beam prong 22A.

Figure 6B:
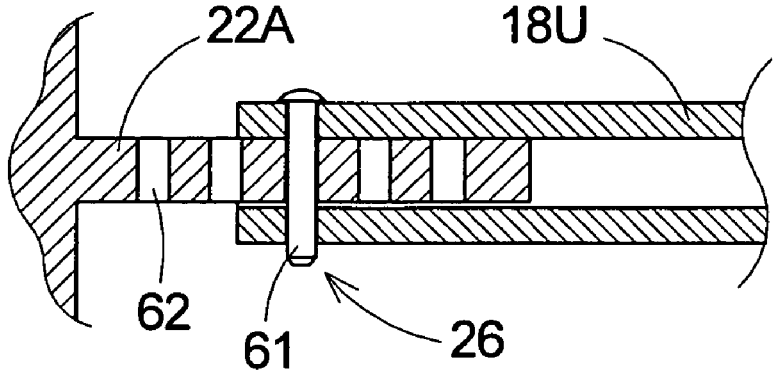
FIG. 6B is a cross-section view of a second embodiment of the locking means of the universally adjustable bed loft.

FIG. 6B depicts a hole in the support beam 18U and multiple holes in the support beam prong 22A. A pin 61 can engage one of the holes 62 of the support beam prong 22A through the support beam 18U to lock movement of the support beam 18U.

Figure 6C:
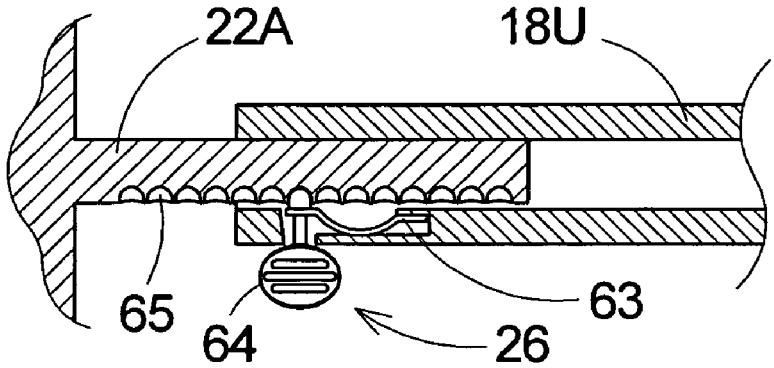
FIG. 6C is a cross-section view of a third embodiment of the locking means of the universally adjustable bed loft.

FIG. 6C depicts the support beam 18U including a spring 63 based detent 64 that would engage one of multiple indents 65 in the support beam prong 22A to prevent the support beam 18U from moving along the support beam prong 22A.

Figure 6D:
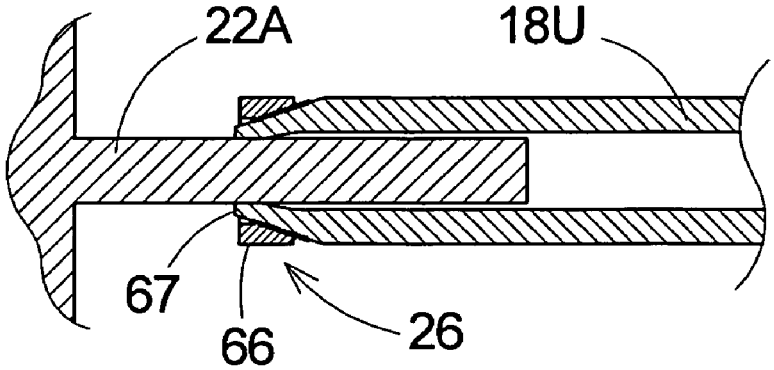
FIG. 6D is a cross-section view of a fourth embodiment of the locking means of the universally adjustable bed loft.

FIG. 6D depicts a collet 66 that radially pinches a swaged end 67 of the support beam 18U around the outer diameter of the support beam prong 22A. The collet 66 and swaged end 67 are threaded to allow the collet 66 to tighten around the swaged end 67.

The embodiments in FIGS. 6A and 6B are limited to securing the support beam 18U in linear increments equal to the placements of holes 62 or indents 65. The embodiments in FIGS. 6A and 6D would be able to secure the support beam 18U at any specific measurement desired. The locking means 26 described can also be used in conjunction with the end assembly support beams 16A, 16B, 16C, 16D, 16E, 16F and end assembly prongs 17A, 17B, 17C, 17D 17E, 17F, 17G, 17H, 171, 17J, 17K, 17L. Other locking methods may also be used.

A method for configuring the universally adjustable bed loft 10 to an existing bed frame 2 includes three basic steps. The first step is to assemble the two end assemblies 12F, 12B without locking them in place and then place them flat on the floor at either end of the bed frame 2. The width of the end assemblies 12F, 12B can be adjusted to the precise distance between the bed legs 4A, 4B, 4C, 4D while the end assemblies 12F, 12B are lying on the floor. The locking means 26 can then be engaged to fix the width of the end assemblies 12F, 12B. The second step is to place the two end assemblies 12F, 12B on their sides so that the support prongs 22A, 22B, 22C, 22D are lying along the floor at the ends of the bed frame 2 and connect the two end assemblies 12F, 12B with support beam 18U, 18L. Similar to the end assemblies 12F, 12B, the support beams 18U, 18L can be adjusted precisely to the length of the bed frame 2. The locking means 26 of the support beams 18U, 18L can then be employed to fix the length of the universally adjustable bed loft 10. The last step is to place the universally adjustable bed loft 10 in the upright position. Finally, the bed frame 2 can be set atop an upright universally adjustable bed loft 10.

Although the present invention has been described with reference to preferred embodiments, workers skilled in the art will recognize that changes may be made in form and detail without departing from the spirit and scope of the invention.

The invention claimed is:

1. A bed loft configured to support legs of a bedframe, the bed loft comprising:

a pair of end assemblies, each end assembly comprising:

a first post comprising:

at least one non-removable support beam prong;

at least one non-removable end assembly prong; and a receiver for holding a foot of a bedpost; and a second post comprising:

at least one end assembly support beam for receiving an end assembly prong of the first post; and a receiver for holding a foot of a bedpost; and a first support beam having a first end for receiving a support beam prong from a first end assembly and a second end for receiving a support beam prong from a second end assembly.

2. The bed loft of claim 1 wherein the first post and second post of each end assembly have a receiver unit for accepting a foot of a bed frame.

3. The bed loft of claim 1 wherein the end assembly support beam is removably attached to the second post.

4. The bed loft of claim 1 wherein the second post is comprised of at least one end assembly prong.

5. The bed loft of claim 1 wherein the first post and second post are comprised of stackable interconnected sections.

6. The bed loft of claim 1 wherein the end assembly support beam is flat.

7. The bed loft of claim 1 wherein the support beam and end assembly support beam include a locking means.

8. The support beam and end assembly support beam of claim 7 wherein the locking means comprises a tension screw device.

9. The support beam and end assembly support beam of claim 7 wherein the locking means comprises a pin device.

10. The support beam and end assembly support beam of claim 7 wherein the locking means comprises a spring biased detent device.

11. The support beam and end assembly support beam of claim 7 wherein the locking means comprises a collet for tightening around a swaged end of the support beam or end assembly support beam.

12. The bed loft of claim 1 wherein the first support beam and end assembly support beam are of a telescoping construction.

13. The bed loft of claim 1 wherein the support beam prongs and end assembly prongs are of a telescoping construction.

14. The bed loft of claim 1 and further comprising a second support beam for connecting the first end assembly with the second end assembly.

15. A bed loft configured to support legs of a bedframe, the bed loft comprising:

a first post comprising:

at least one non-removable support beam prong;

at least one non-removable end assembly prong; and a receiver for holding a foot of a bedpost;

a second post comprising:

at least one end assembly support beam for receiving an end assembly prong of the first post; and a receiver for holding a foot of a bedpost;

a third post comprising:

at least one non-removable support beam prong;

at least one non-removable end assembly prong; and a receiver for holding a foot of a bedpost a fourth post comprising:

at least one end assembly support beam for receiving an end assembly prong of the third post; and a receiver for holding a foot of a bedpost; and a first support beam having a first end for receiving a support beam prong of the first post and a second end for receiving a support beam prong of the third post.

16. The bed loft of claim 15 wherein the end assembly support beam of the second post and the end assembly support beam of the fourth post are of a telescoping construction.

17. The bed loft of claim 15 wherein the first post, second post, third post and fourth post are comprised of stackable interconnected sections.

18. The bed loft of claim 15 wherein the end assembly support beam of the second post and the end assembly support beam of the fourth post are flat.

19. The bed loft of claim 15 wherein the support beam prongs and end assembly prongs are of a telescoping construction.

20. The bed loft of claim 15 wherein the first support beam is of a telescoping construction.

21. The bed loft of claim 15 wherein the first support beam and end assembly support beams include a locking means.

22. The support beam and end assembly support beam of claim 21 wherein the locking means comprises a tension screw device.

23. The support beam and end assembly support beam of claim 21 wherein the locking means comprises a pin device.

24. The support beam and end assembly support beam of claim 21 wherein the locking means comprises a spring biased detent device.

25. The support beam and end assembly support beam of claim 21 wherein the locking means comprises a collet for tightening around a swaged end of the support beam or end assembly support beam.

26. The bed loft of claim 15 wherein the receivers comprise:

a plurality of barriers that are each co-planar with a wall of one of the posts; and a platform positioned between the walls of the post.

27. The bed loft of claim 15 and further comprising a second support beam for connecting the first post and the third post.

28. A bed loft comprising:

a first end assembly comprising:

a first post;

a second post; and a first telescoping end assembly support beam for connecting the first post and second post;

a second end assembly comprising:

a third post;

a fourth post; and a second telescoping end assembly support beam for connecting the third post to the fourth post;

a receiver positioned at the top of each post comprising:

a plurality of barriers that are each co-planar with a wall of the post; and a platform positioned between the walls of the post; and a first telescoping loft assembly support beam for connecting the first post of the first end assembly to the third post of the second end assembly.

29. The bed loft of claim 28 wherein the first telescoping end assembly beam is removably attached to the first post and second post.

30. The bed loft of claim 28 wherein the second telescoping end assembly beam is removably attached to the third post and fourth post.

31. The bed loft of claim 28 wherein the telescoping loft assembly beam is removably attached to the first post and third post.

32. The bed loft of claim 28 wherein the first post, second post, third post and fourth post are comprised of stackable interconnected sections.

33. The bed loft of claim 28 wherein the first and second telescoping end assembly support beams are flat.

34. The bed loft of claim 28 wherein the first and second telescoping end assembly support beams and the first telescoping loft assembly beam include a locking means.

35. The first and second telescoping end assembly support beams and the telescoping loft assembly beam of claim 34 wherein the locking means comprises a tension screw device.

36. The first and second telescoping end assembly support beams and the telescoping loft assembly beam of claim 34 wherein the locking means comprises a pin device.

37. The first and second telescoping end assembly support beams and the telescoping loft assembly beam of claim 34 wherein the locking means comprises a spring biased detent device.

38. The first and second telescoping end assembly support beams and the telescoping loft assembly beam of claim 34 wherein the locking means comprises a collet for tightening around a swaged end of the support beam or end assembly support beam.

39. The bed loft of claim 28 wherein the barriers are formed from the walls of the first post, second post, third post or fourth post, respectively.

40. The bed loft of claim 28 and further comprising a second telescoping loft assembly support beam for connecting the first post and the third post.

41. The bed loft of claim 28 wherein:

the first post further comprises:

a first non-removable end assembly prong for joining the first end assembly support beam with the first post; and a first non-removable loft assembly prong for receiving a first end of the first loft assembly support beam; and wherein the third post further comprises:

a second non-removable end assembly prong for joining the second end assembly support beam with the third post; and a second non-removable loft assembly prong for receiving a second end of the first loft assembly support beam.

42. A bed loft comprising:

a first end assembly comprising:

a first post;

a second post; and a plurality of telescoping first end assembly support beams for connecting the first post and second post;

a second end assembly comprising:

a third post;

a fourth post; and a plurality of telescoping second end assembly support beams for connecting the third post to the fourth post; and a plurality of first side telescoping loft assembly support beams for connecting the first post of the first end assembly to the third post of the second end assembly.

43. The bed loft of claim 42 wherein the plurality of first side telescoping loft assembly support beams run parallel to each other.

44. A method for assembling a universally adjustable bed loft, the method comprising:

assembling a pair of end assemblies by inserting a non-removable end assembly prong of a first post into an end assembly support beam of a second post;

adjusting a width of the end assembly to a width of an existing bed;

applying a locking means of an end assembly support beam to fix the width of the end assembly at the width of the existing bed;

connecting a support beam to a pair of end assemblies by inserting non-removable loft support beam prongs into a loft support beam;

adjusting a length of the universally adjustable bed loft to a length of the existing bed; and applying a locking means of the support beam to fix the length of the universally adjustable bed loft at a width of the existing bed.

45. The method of claim 44 wherein the method of adjusting the width of the end assembly to the width of the existing bed comprises lying the end assembly next to the existing bed to match the width.

46. The method of claim 44 wherein the method of adjusting the length of the universally adjustable bed loft to the length of the existing bed comprises placing the universally adjustable bed loft next to the existing bed to match the length.

47. The method of claim 44 wherein the assembling a pair of end assemblies comprises connecting together sections of a post comprising the end assembly to a desired height.

48. The method of claim 44 wherein the assembling a pair of end assemblies comprises connecting a receiver for accepting a bed leg to the end assembly.

49. A method for adjusting a bed loft to the dimensions of a desired bed frame, the method comprising:

adjusting a width of a first end assembly to a width of a bed frame wherein the width of the first end assembly is controlled by adjusting a length of a first end assembly prong inserted into a telescoping support beam connecting two posts of the first end assembly, wherein the prong is non-removably attached to one of the posts of the first end assembly;

adjusting a width of a second end assembly to the width of the bed frame wherein the width of the second end assembly is controlled by adjusting a length of a second end assembly prong inserted into a telescoping support beam connecting two posts of the second end assembly, wherein the prong is non-removably attached to one of the posts of the second end assembly; and adjusting a length between the first and second end assemblies to a length of the bed frame wherein the length between the first and second end assemblies is controlled by adjusting a length of a support beam prong inserted into a telescoping support beam connecting the first and second end assemblies, wherein the support beam prong is non-removably attached to one of the posts.

50. A bed loft configured to support legs of a bedframe, the bed loft comprising:

a pair of end assemblies, each end assembly comprising:

a first post comprising:

at least one non-removable support beam prong;

at least one non-removable end assembly support beam; and a receiver for holding a foot of a bedpost; and a second post comprising:

at least one non-removable end assembly prong for receiving an end assembly support beam of the first post; and a receiver for holding a foot of a bedpost; and a first support beam having a first end for receiving a support beam prong from a first end assembly and a second end for receiving a support beam prong from a second end assembly.

51. The bed loft of claim 50 wherein the receivers for holding a foot of a bed post are comprised of barriers and a platform, wherein the barriers are formed from and co-planer with walls of the first post or second post and the platform is located between the walls of the first post or second post.

52. The bed loft of claim 50 and further comprising a second support beam for connecting the first end assembly with the second end assembly.

53. A bed loft configured to support legs of a bedframe, the bed loft comprising:

first and second end assemblies, each end assembly comprising:

a first post comprising:

at least one support beam prong;

at least one end assembly prong; and a receiver for holding a foot of a bedpost comprising:

barriers that are co-planar with walls of the first post; and a platform positioned between the walls of the first post; and a second post comprising:

at least one end assembly support beam for receiving an end assembly prong of the first post; and a receiver for holding a foot of a bedpost comprising:

barriers that are co-planar with walls of the second post; and a platform positioned between the walls of the second post; and a first support beam having a first end for receiving a support beam prong from the first end assembly and a second end for receiving a support beam prong from the second end assembly.

54. The bed loft of claim 53 and further comprising a second support beam for connecting the first end assembly with the second end assembly.

* * * * *

UNITED STATES PATENT AND TRADEMARK OFFICE

CERTIFICATE OF CORRECTION

PATENT NO. : 7,096,523 B2
APPLICATION NO. : 10/976224
DATED : August 29, 2006
INVENTOR(S) : Eric D. Hennings et al.

It is certified that error appears in the above-identified patent and that said Letters Patent is hereby corrected as shown below:

Column 6, Line 5, delete "171", insert --17I--

Column 6, Line 17, delete "241", insert --24I--

Column 6, Line 18, delete "241", insert --24I--

Signed and Sealed this

Second Day of January, 2007

JON W. DUDAS
*Director of the United States Patent and Trademark Office*